US010156381B1

(12) United States Patent
Settler

(10) Patent No.: US 10,156,381 B1
(45) Date of Patent: Dec. 18, 2018

(54) LIGHTED AIR DISPERSING ASSEMBLY

(71) Applicant: Andrew Settler, Littleton, CO (US)

(72) Inventor: Andrew Settler, Littleton, CO (US)

( * ) Notice: Subject to any disclaimer, the term of this patent is extended or adjusted under 35 U.S.C. 154(b) by 0 days.

(21) Appl. No.: 15/623,034

(22) Filed: Jun. 14, 2017

(51) Int. Cl.

| | |
|---|---|
| ***G09F 13/04*** | (2006.01) |
| ***F24F 13/078*** | (2006.01) |
| ***F21V 33/00*** | (2006.01) |
| ***F21V 23/00*** | (2015.01) |
| ***F24F 13/075*** | (2006.01) |
| *F21Y 115/10* | (2016.01) |
| *F21Y 113/13* | (2016.01) |

(52) U.S. Cl.
CPC ..... *F24F 13/078* (2013.01); *F21V 23/003* (2013.01); *F21V 33/0088* (2013.01); *F24F 13/075* (2013.01); *F21Y 2113/13* (2016.08); *F21Y 2115/10* (2016.08)

(58) Field of Classification Search
CPC ..... F24F 13/078; F24F 13/075; F21V 23/003; F21V 33/0088; F21Y 2113/13; F21Y 2115/10
See application file for complete search history.

(56) References Cited

U.S. PATENT DOCUMENTS

| | | | | |
|---|---|---|---|---|
| 2,960,602 | A | 11/1960 | Kurth | |
| 4,449,166 | A | 5/1984 | Sharp | |
| D325,434 | S | 4/1992 | Dosman | |
| 7,384,168 | B2 | 6/2008 | Whitlow | |
| 9,086,246 | B2 | 7/2015 | Bollman | |
| 2009/0298406 | A1* | 12/2009 | Norbury, Jr. | B60H 1/34 454/69 |
| 2011/0072697 | A1* | 3/2011 | Miller | G09F 9/33 40/564 |
| 2014/0063796 | A1* | 3/2014 | Zakula | F24F 13/078 362/231 |
| 2016/0097512 | A1 | 4/2016 | de Oliveira | |

FOREIGN PATENT DOCUMENTS

| | | |
|---|---|---|
| WO | WO2016054635 | 4/2016 |

* cited by examiner

*Primary Examiner* — Tracie Y Green

(57) ABSTRACT

A lighted air dispersing assembly for selectively illuminating a ventilated space includes a housing that is configured to couple to a ventilation pipe. A plurality of channels is positioned through the housing. The channels are configured to allow air to flow from the ventilation pipe through the housing to a space proximate to the housing. A plurality of light emitting diodes is coupled to a first face of the housing. The plurality of light emitting diodes is operationally coupled to an electrical circuit. The light emitting diodes are configured to selectively illuminate the space proximate to the housing.

15 Claims, 6 Drawing Sheets

LIGHTED AIR DISPERSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to air dispersing assemblies and more particularly pertains to a new air dispersing assembly for selectively illuminating a ventilated space.

BRIEF SUMMARY OF THE INVENTION

An embodiment of the disclosure meets the needs presented above by generally comprising a housing that is configured to couple to a ventilation pipe. A plurality of channels is positioned through the housing. The channels are configured to allow air to flow from the ventilation pipe through the housing to a space proximate to the housing. A plurality of light emitting diodes is coupled to a first face of the housing. The plurality of light emitting diodes is operationally coupled to an electrical circuit. The light emitting diodes are configured to selectively illuminate the space proximate to the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
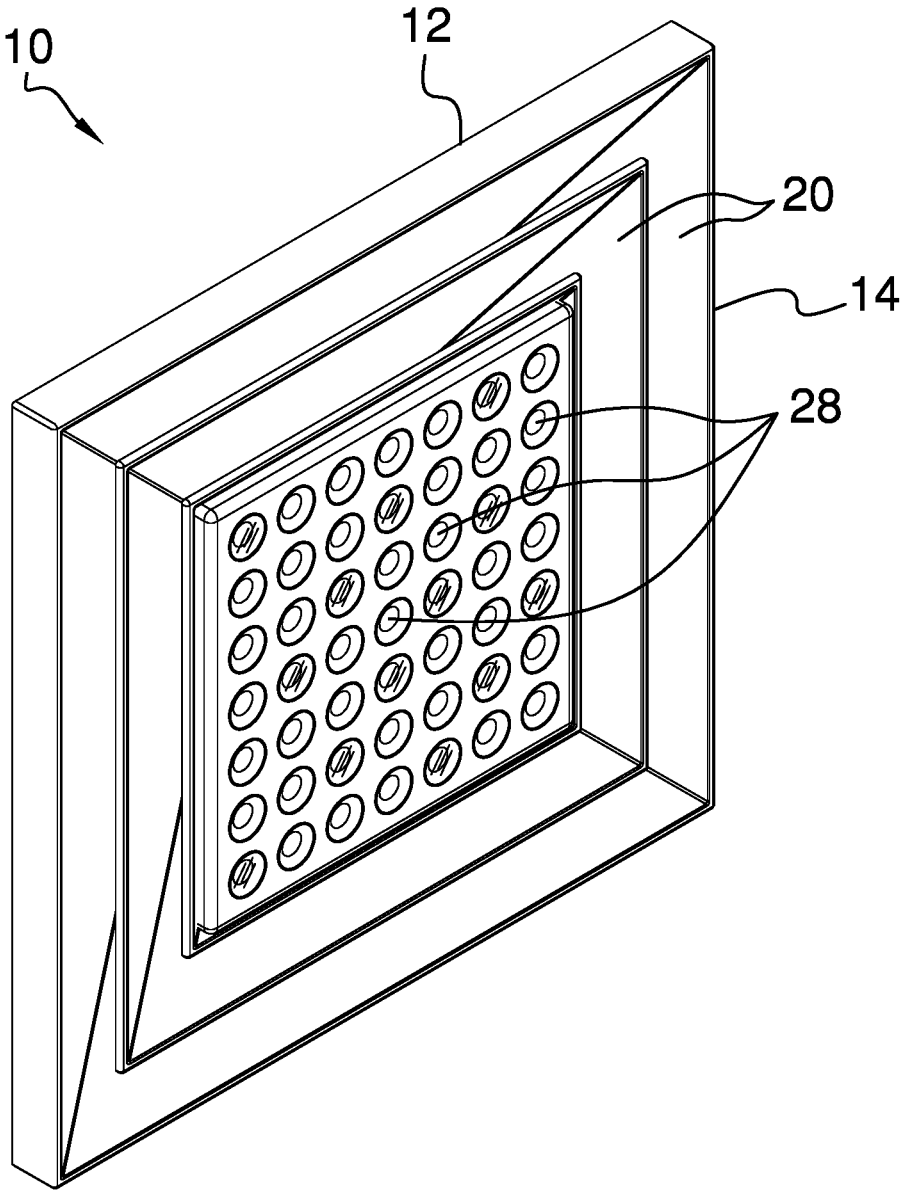
FIG. 1 is an isometric perspective view of a lighted air dispersing assembly according to an embodiment of the disclosure.
Figure 2:
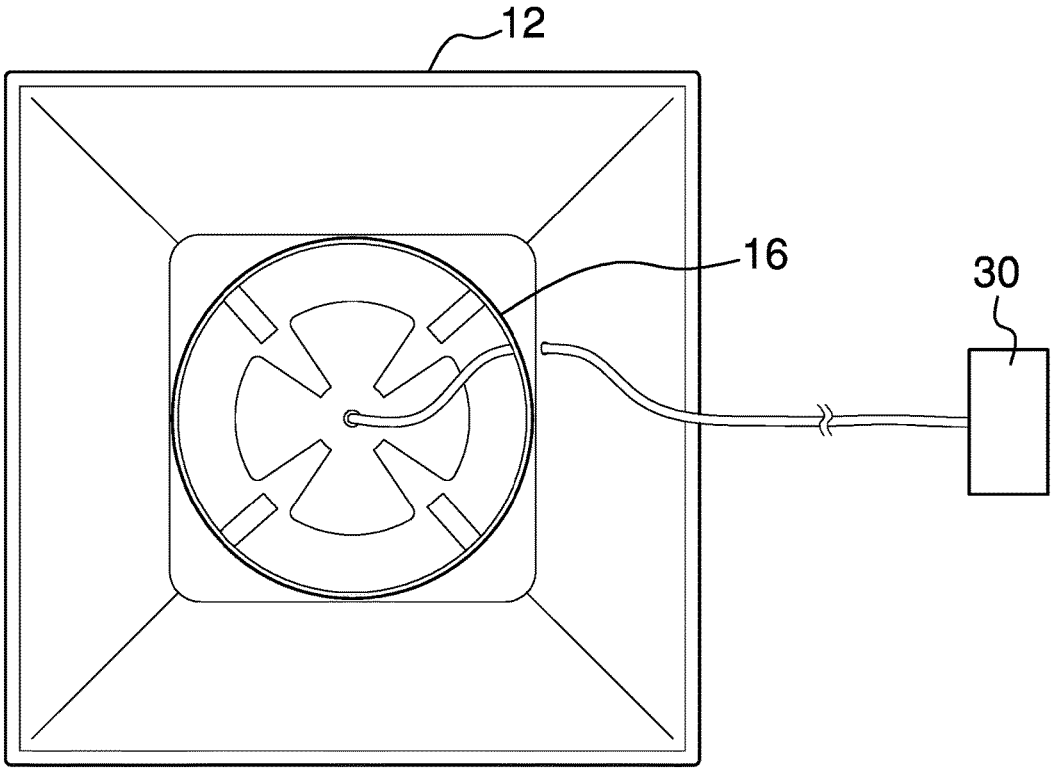
FIG. 2 is a back view of an embodiment of the disclosure.
Figure 3:
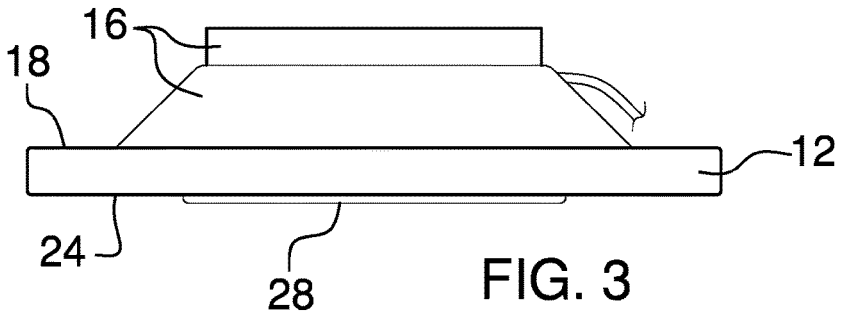
FIG. 3 is a side view of an embodiment of the disclosure.
Figure 4:
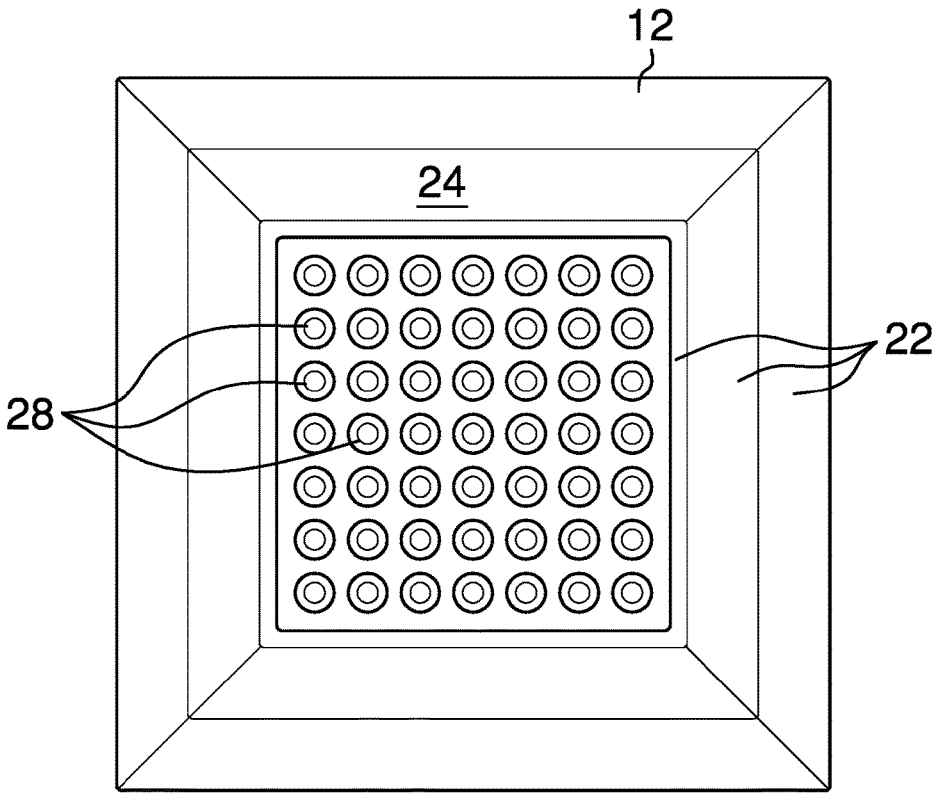
FIG. 4 is a front view of an embodiment of the disclosure.
Figure 5:
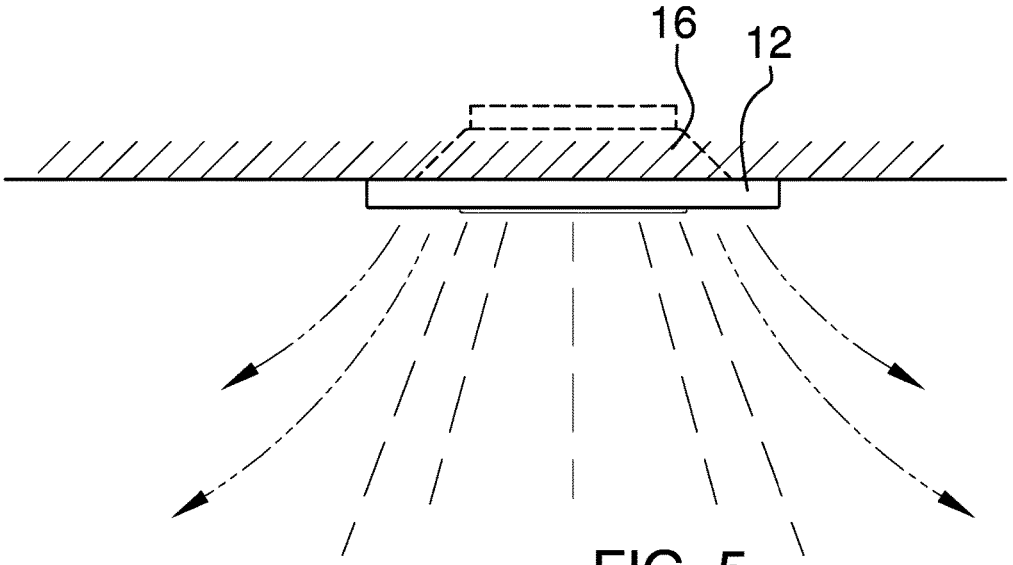
FIG. 5 is an in-use view of an embodiment of the disclosure.
Figure 6:
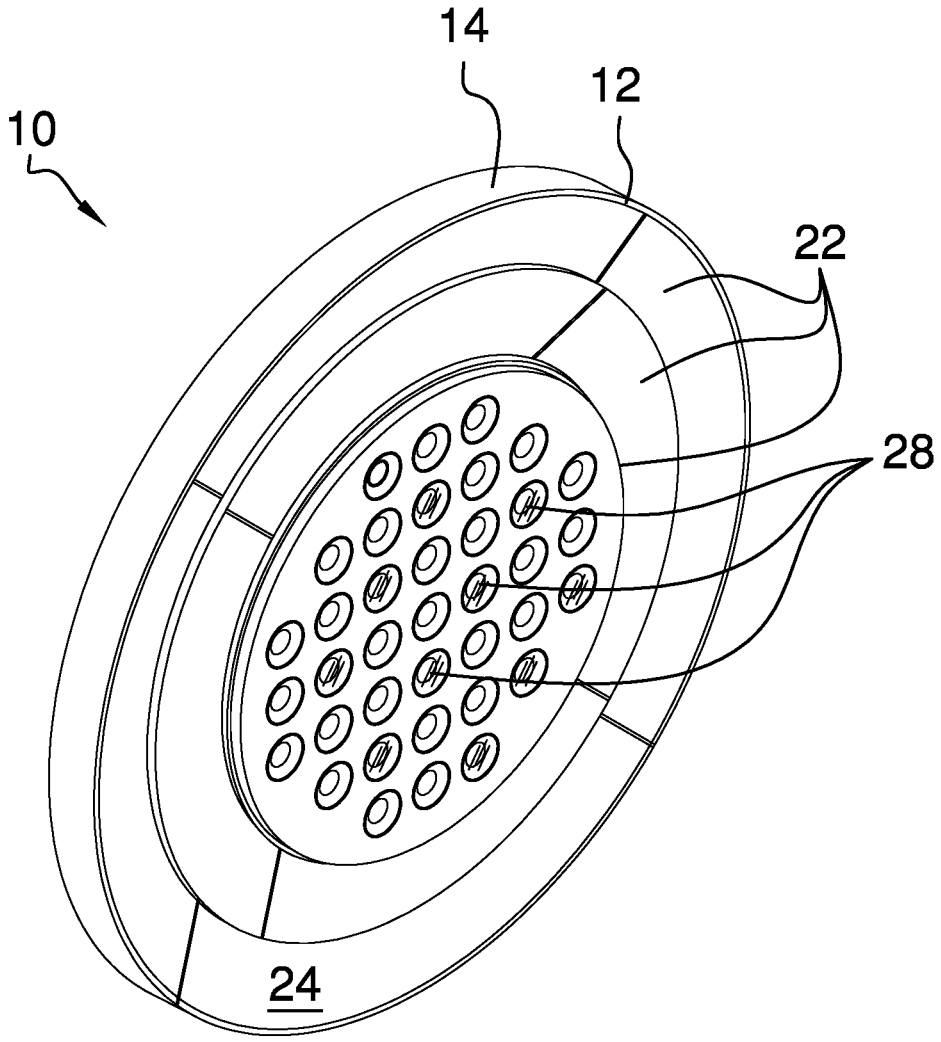
FIG. 6 is an isometric perspective view of an embodiment of the disclosure.
Figure 7:
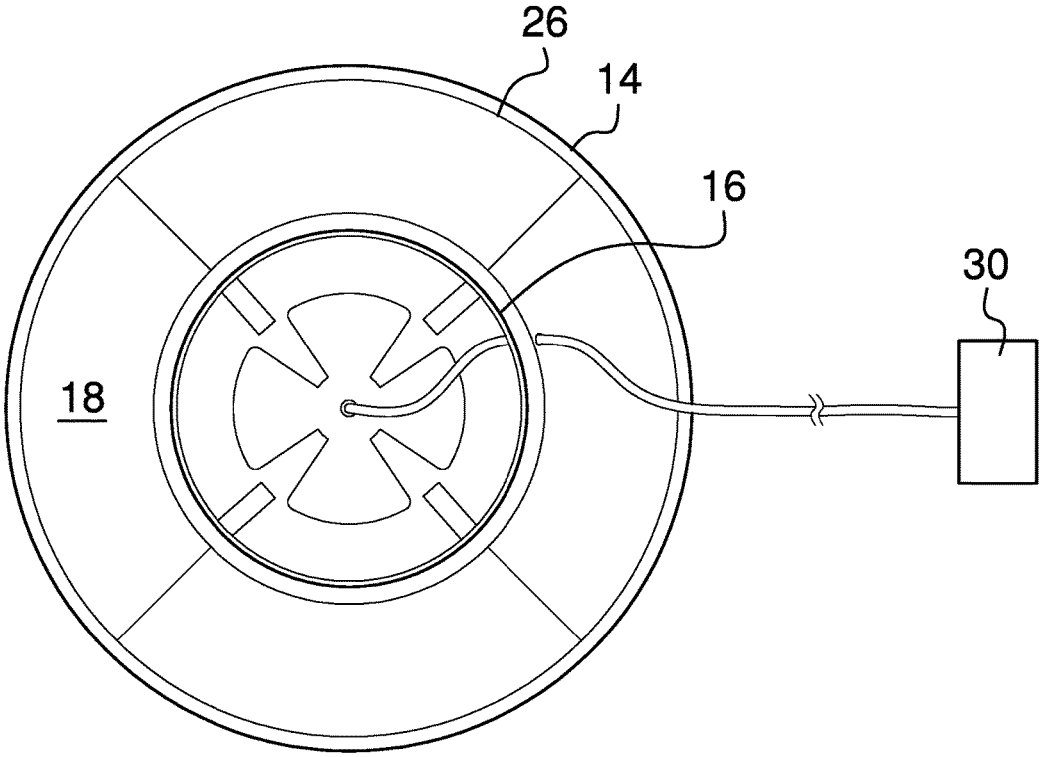
FIG. 7 is a back view of an embodiment of the disclosure.
Figure 8:
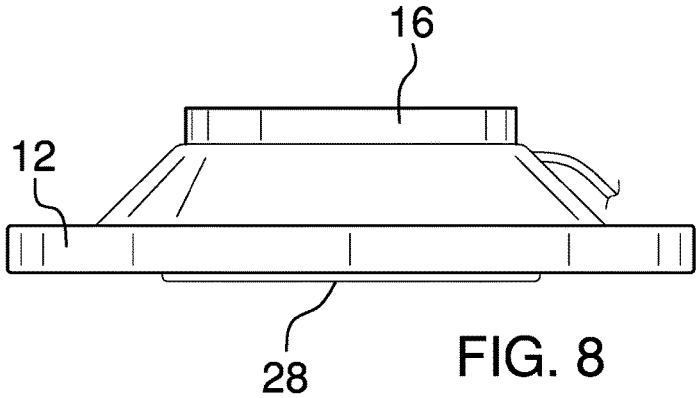
FIG. 8 is a side view of an embodiment of the disclosure.
Figure 9:
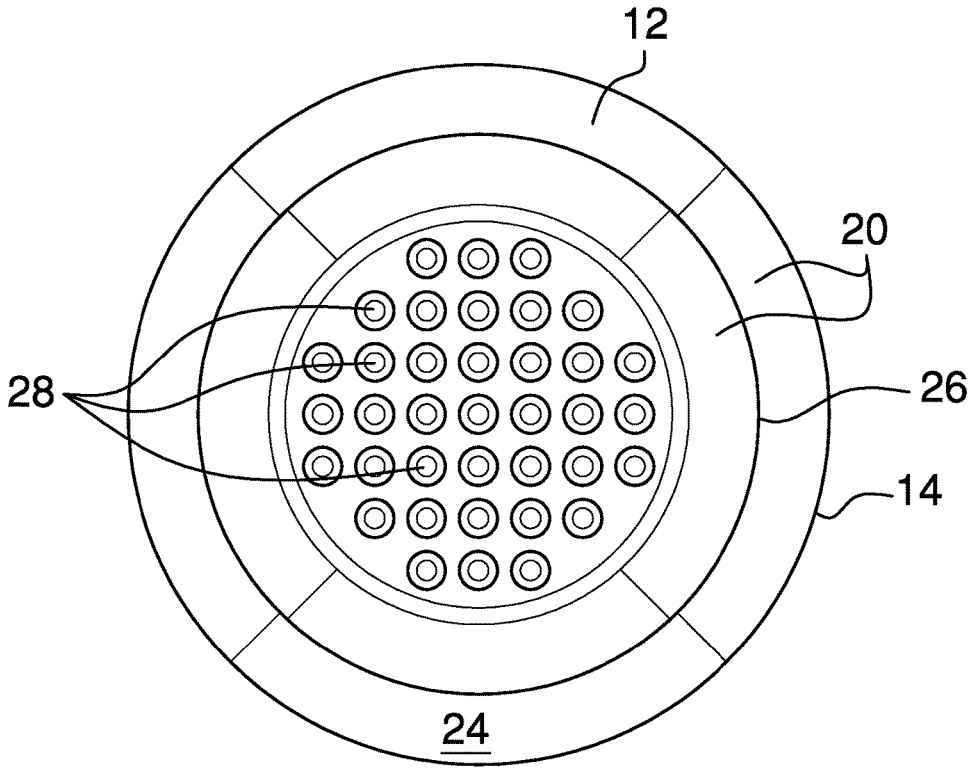
FIG. 9 is a front view of an embodiment of the disclosure.
Figure 10:
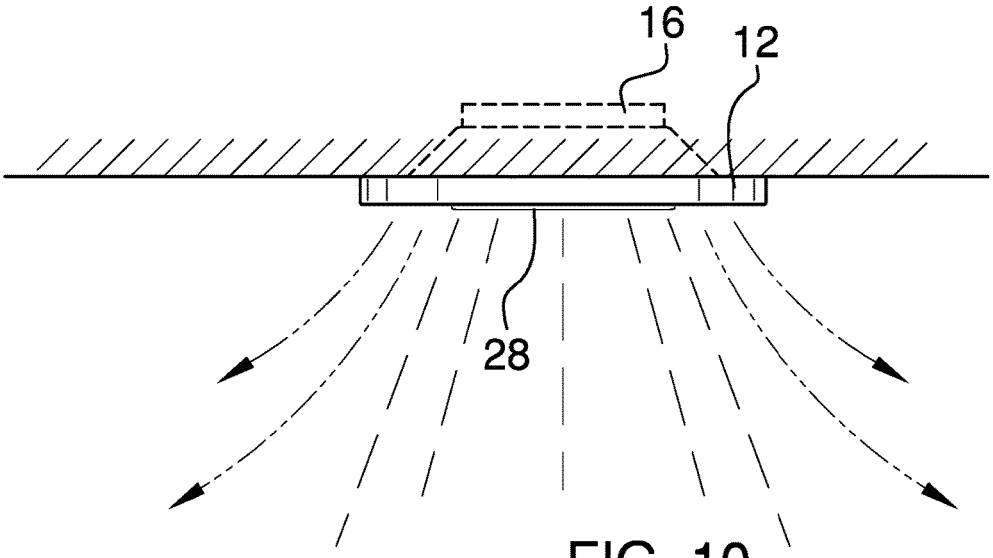
FIG. 10 is an in-use view of an embodiment of the disclosure.

With reference now to the drawings, and in particular to FIGS. 1 through 10 thereof, a new air dispersing assembly embodying the principles and concepts of an embodiment of the disclosure and generally designated by the reference numeral 10 will be described.

As best illustrated in FIGS. 1 through 10, the lighted air dispersing assembly 10 generally comprises a housing 12 that is configured to couple to a ventilation pipe. The housing 12 has a perimeter 14. In one embodiment, the perimeter 14 is substantially rectangularly shaped. In another embodiment, the perimeter 14 is substantially squarely shaped. In yet another embodiment, the perimeter 14 is substantially circularly shaped.

A tube 16 is coupled to and extends from a back face 18 of the housing 12. The tube 16 is complementary to the ventilation pipe. The tube 16 is configured to couple to the ventilation pipe to couple the housing 12 to the ventilation pipe.

A plurality of channels 20 is positioned through the housing 12. The channels 20 are configured to allow air to flow from the ventilation pipe through the housing 12 to a space proximate to the housing 12.

A plurality of slats 22 is coupled to and extends angularly between a front face 24 and the back face 18 of the housing 12. Adjacently positioned slats 22 define a respective channel 20. The slats 22 are configured to disperse the air that flows from the ventilation pipe through the housing 12. Each slat 22 has a respective circumference 26 so that the plurality of slats 22 has a variety of circumferences 26. In one embodiment, the plurality of slats 22 comprises three slats 22.

A plurality of light emitting diodes 28 is coupled to the front face 24 of the housing 12. The plurality of light emitting diodes 28 is operationally coupled to an electrical circuit. The light emitting diodes 28 are configured to selectively illuminate the space proximate to the housing 12. In one embodiment, the plurality of light emitting diodes 28 is centrally positioned on the front face 24 of the housing 12. In another embodiment, the plurality of light emitting diodes 28 is positioned proximate to the perimeter 14 of the housing 12. In yet another embodiment, each light emitting diode 28 has a respective color so that the plurality of light emitting diodes 28 has a variety of colors.

A controller 30 is operationally coupled to the plurality of light emitting diodes 28 and the electrical circuit. The controller 30 is configured to selectively couple the light emitting diodes 28 to the electrical circuit to compel the light emitting diodes 28 to illuminate the space proximate to the housing 12. In one embodiment, the controller 30 is configured to set a brightness level of the light emitting diodes 28. In another embodiment, the controller 30 is configured to selectively couple respective light emitting diodes 28 to select a color of light to illuminate the space proximate to the housing 12. In yet another embodiment, the controller 30 is configured to alternately selectively couple respective light emitting diodes 28 to cycle respective colors of light to illuminate the space proximate to the housing 12. The present invention also anticipates the controller 30 being wirelessly operationally coupled to the plurality of light emitting diodes 28.

In use the tube 16 that is positioned on the housing 12 is configured to couple to the ventilation pipe to couple the housing 12 to the ventilation pipe. The slats 22 that are positioned in the housing 12 are configured to disperse the air that flows from the ventilation pipe through the housing 12. The controller 30 is configured to selectively couple the light emitting diodes 28 to the electrical circuit to compel the light emitting diodes 28 to illuminate the space proximate to the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lighted air dispersing assembly comprising:

a housing configured for coupling to a ventilation pipe, said housing having a perimeter extending around a first face of said housing;

a plurality of channels positioned through said housing, said channels being concentrically arranged around said first face of said housing and arranged radially from said first face to said perimeter;

a plurality of slats coupled to and extending angularly in a fixed position between said first face and a second face of said housing such that adjacently positioned said slats define a respective said channel, wherein said slats are positioned in said housing such that said slats are configured for dispersing the air flowing from the ventilation pipe through said housing and around said first face of said housing;

a plurality of light emitting diodes coupled to said first face of said housing, said plurality of light emitting diodes being operationally coupled to an electrical circuit; and wherein said channels are positioned in said housing such that said channels are configured for flowing of air from the ventilation pipe through said housing to a space proximate to said housing, wherein said light emitting diodes are positioned on said housing such that said light emitting diodes are configured for selectively illuminating the space proximate to said housing.

2. The assembly of claim 1, further including said perimeter being substantially rectangularly shaped.

3. The assembly of claim 1, further including said perimeter being substantially squarely shaped.

4. The assembly of claim 1, further including said perimeter being substantially circularly shaped.

5. The assembly of claim 1, further including a tube coupled to and extending from a back face of said housing, said tube being complementary in shape to the ventilation pipe, wherein said tube is positioned on said housing such that said tube is configured for coupling to the ventilation pipe for coupling said housing to the ventilation pipe.

6. The assembly of claim 1, further including said plurality of light emitting diodes being centrally positioned on said first face of said housing.

7. The assembly of claim 1, further including said plurality of light emitting diodes being positioned proximate to a perimeter of said housing.

8. The assembly of claim 1, further including each said light emitting diode having a respective color such that said plurality of light emitting diodes has a variety of colors.

9. The assembly of claim 1, further including each said slat having a respective circumference such that said plurality of slats has a variety of circumferences.

10. The assembly of claim 1, further including said plurality of slats comprising three said slats.

11. The assembly of claim 1, further including a controller operationally coupled to said plurality of light emitting diodes and the electrical circuit, wherein said controller is coupled to said light emitting diodes such that said controller is configured for selectively coupling said light emitting diodes to the electrical circuit for compelling said light emitting diodes for illuminating the space proximate to said housing.

12. The assembly of claim 11, further including said controller being configured for setting a brightness level of said light emitting diodes.

13. The assembly of claim 8, further including a controller operationally coupled to said plurality of light emitting diodes and the electrical circuit, said controller being configured for selectively coupling respective said light emitting diodes for selecting a color of light for illuminating the space proximate to said housing.

14. The assembly of claim 13, further including said controller being configured for alternately selectively coupling respective said light emitting diodes for cycling respective colors of light for illuminating the space proximate to said housing.

15. A lighted air dispersing assembly comprising:

a housing configured for coupling to a ventilation pipe, said housing having a perimeter extending around a first face of said housing;

a tube coupled to and extending from a back face of said housing, said tube being complementary in shape to the ventilation pipe, wherein said tube is positioned on said housing such that said tube is configured for coupling to the ventilation pipe for coupling said housing to the ventilation pipe;

a plurality of channels positioned through said housing, wherein said channels are positioned in said housing such that said channels are configured for flowing of air from the ventilation pipe through said housing to a space proximate to said housing, said channels being concentrically arranged around said first face of said housing and arranged radially from said first face to said perimeter;

a plurality of light emitting diodes coupled to said first face of said housing, said plurality of light emitting diodes being operationally coupled to an electrical circuit, wherein said light emitting diodes are positioned on said housing such that said light emitting diodes are configured for selectively illuminating the space proximate to said housing, said plurality of light emitting diodes being centrally positioned on said first face of said housing, said plurality of light emitting diodes being positioned proximate to said perimeter of said housing, each said light emitting diode having a respective color such that said plurality of light emitting diodes has a variety of colors;

a plurality of slats coupled to and extending angularly between said first face and said second face of said housing such that adjacently positioned said slats define a respective said channel, wherein said slats are positioned in said housing such that said slats are configured for dispersing the air flowing from the ventilation pipe through said housing, each said slat having a respective circumference such that said plurality of slats has a variety of circumferences, said plurality of slats comprising three said slats;

a controller operationally coupled to said plurality of light emitting diodes and the electrical circuit, wherein said controller is coupled to said light emitting diodes such that said controller is configured for selectively coupling said light emitting diodes to the electrical circuit for compelling said light emitting diodes for illuminating the space proximate to said housing, said controller being configured for setting a brightness level of said light emitting diodes, said controller being configured for selectively coupling respective said light emitting diodes for selecting a color of light for illuminating the space proximate to said housing, said controller being configured for alternately selectively coupling respective said light emitting diodes for cycling respective colors of light for illuminating the space proximate to said housing; and wherein said tube is positioned on said housing such that said tube is configured for coupling to the ventilation pipe for coupling said housing to the ventilation pipe, wherein said slats are positioned in said housing such that said slats are configured for dispersing the air flowing from the ventilation pipe through said housing, wherein said controller is coupled to said light emitting diodes such that said controller is configured for selectively coupling said light emitting diodes to the electrical circuit for compelling said light emitting diodes for illuminating the space proximate to said housing.

* * * * *